United States Patent [19]

Anderson

[11] Patent Number: 4,950,033

[45] Date of Patent: Aug. 21, 1990

[54] PORTABLE STOOL WITH WEIGHT DISTRIBUTION FLANGE

[76] Inventor: Dennis L. Anderson, 1821 E. Maryland, Phoenix, Ariz. 85016

[21] Appl. No.: 309,879

[22] Filed: Feb. 13, 1989

[51] Int. Cl.[5] ..... A47C 16/02

[52] U.S. Cl. ..... 297/461; 297/223; 297/439; 182/33

[58] Field of Search ..... 297/193, 250, 439, 440, 297/461, 219, 223; 182/33, 46; 108/91, 100, 157

[56] References Cited

U.S. PATENT DOCUMENTS

| | | | |
|---|---|---|---|
| D. 131,473 | 3/1942 | Thelander . | |
| D. 160,390 | 10/1950 | Hubbert | D15/8 |
| 42,302 | 4/1864 | Macferran . | |
| 279,186 | 6/1883 | Ricker . | |
| 798,574 | 8/1905 | Dunning | 297/193 X |
| 1,429,651 | 9/1922 | Slaght . | |
| 1,635,183 | 7/1927 | Jeannotte . | |
| 1,811,674 | 6/1931 | Longley | 297/439 |
| 2,218,951 | 10/1940 | Flaharty | 297/250 X |
| 2,509,395 | 5/1950 | Madan | 297/193 X |
| 2,670,891 | 3/1954 | Michaelis et al. | 228/16 |
| 2,725,923 | 12/1955 | Bachrach . | |
| 2,770,293 | 11/1956 | Eichorst . | |
| 2,877,830 | 3/1959 | Smith . | |
| 2,919,169 | 12/1959 | Jackson | 297/461 X |
| 3,382,001 | 5/1968 | Schafer et al. | 297/462 |
| 3,669,494 | 6/1972 | Lohmeyer | 297/440 |
| 3,744,409 | 7/1973 | Bradbury, II | 297/193 X |
| 3,892,441 | 7/1975 | Roeshman | 297/461 |
| 4,236,599 | 12/1980 | Luff et al. | 182/33 |

FOREIGN PATENT DOCUMENTS

| | | | |
|---|---|---|---|
| 2031719 | 4/1980 | United Kingdom | 297/193 |

*Primary Examiner*—Peter R. Brown

*Attorney, Agent, or Firm*—Don J. Flickinger; Jordan M. Meschkow; Lowell W. Gresham

[57] ABSTRACT

A stool which includes a box-shaped support, a cushion, and a tether is disclosed. The support includes a pedestal, which surrounds an interior section, and an inwardly extending seat at a top side of the pedestal. An exterior side of the seat forms a slip-resistant surface. The support additionally includes a flange-shaped base extending outward from a bottom side of the pedestal for a predetermined distance. The base is further configured to include an integrally formed handle therein. In addition, the pedestal tapers from a larger cross-sectional area at the bottom side to a smaller cross-sectional area at the top side. The tether movably attaches the support to the cushion so that the cushion may reside in a first position, wherein the stool is configured for sitting, or a second position, wherein the stool is configured for standing.

17 Claims, 1 Drawing Sheet

PORTABLE STOOL WITH WEIGHT DISTRIBUTION FLANGE

TECHNICAL FIELD OF THE INVENTION

The present invention relates generally to stools and like items which support a person or other weight. More specifically, the present invention relates to stools which are specifically adapted for use on soft surfaces, such as the ground.

BACKGROUND OF THE INVENTION

People who attend outdoor sporting events, such as golf, and other public events are often required to spend a considerable amount of time in a relatively confined area. In order to be comfortable, they are occasionally provided with bleachers or other seating arrangements. However, in the case of golf tournaments and various other public events, bleachers are impractical because the areas in which spectators reside tend to be so large that the expense of permanent or temporary bleachers would be prohibitive.

Conventionally, organizers of such events address this problem in one of several different ways. For example, they may prohibit the use of seating devices for many of the spectators, they may provide portable or temporary seating, such as stackable chairs, lawn chairs, and the like, or they may permit spectators to provide their own portable seats. Such conventional seating arrangements produce many undesirable consequences. For example, a prohibition on seating devices produces a considerable amount of discomfort on the part of the spectators. This discomfort may lead to bad publicity and an unwillingness on the part of the spectator to attend similar future events.

In addition, the conventionally utilized seating devices, whether provided by event organizers or spectators themselves, incorporate legs which become easily embedded inthe ground when the spectators sit in them. Such embedding is highly undesirable because it makes the seats difficult to sit in, and it damages the landscape.

Furthermore, such conventionally utilized seating devices are not designed to accommodate being stood upon. Nevertheless, spectators often stand on seating devices at such events due to the emotions generated by the event and a desire to see beyond a crowd of spectators. Consequently, such conventional seating devices quickly become damaged when the spectators stand upon them. Additionally, the conventional seating devices often become unstable when being stood upon. As a result, spectators occasionally fall from their standing position and injure themselves from the fall.

SUMMARY OF THE INVENTION

Accordingly, it is a advantage of the present invention that a stool for public or private use which tends not to damage the landscape is provided.

Another advantage of the present invention is that a stool is provided which remains stable whether a user of the stool is in a sitting or standing position.

Yet another advantage is that the present invention is readily portable so that it may be easily transported from one location to another.

Still another advantage is that the present invention is stackable and relatively inexpensive so that organizers of public events may easily acquire and store a large number of the present invention.

The above and other advantages of the present invention are carried out in one form by an apparatus that includes an upright wall which is shaped to substantially surround an interior section. The upright wall extends from a first side to a second side which opposes the first side. A top surface attaches to the upright wall at the first side and extends in a direction which causes the top surface to form a portion of the boundary for the interior section. A bottom surface rigidly attaches to the upright wall at the second side and extends outward from the upright wall for a predetermined distance.

BRIEF DESCRIPTION OF THE DRAWINGS

A more complete understanding of the present invention may be derived by referring to the detailed description and claims when considered in connection with the FIGS., wherein like reference numbers refer to similar items throughout the FIGS., and:

DETAILED DESCRIPTION OF THE PREFERRED EMBODIMENT

Figure 1:
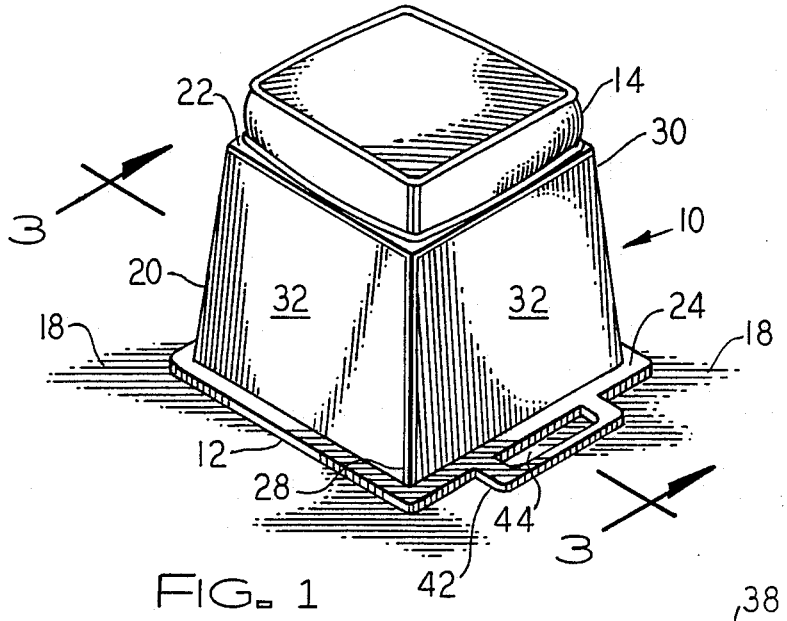
FIG. 1 shows a perspective view of the present invention with a cushion portion thereof in a first position.
Figure 2:
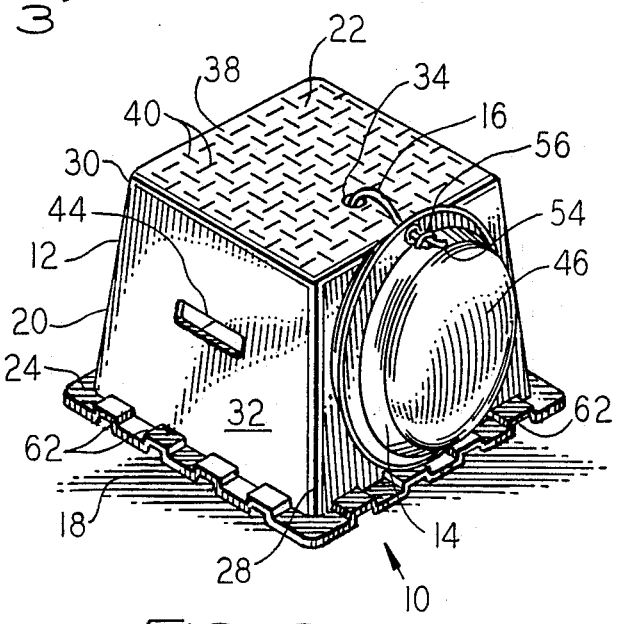
FIG. 2 shows a perspective view of the present invention with cushion portion thereof in a second position.
Figure 3:
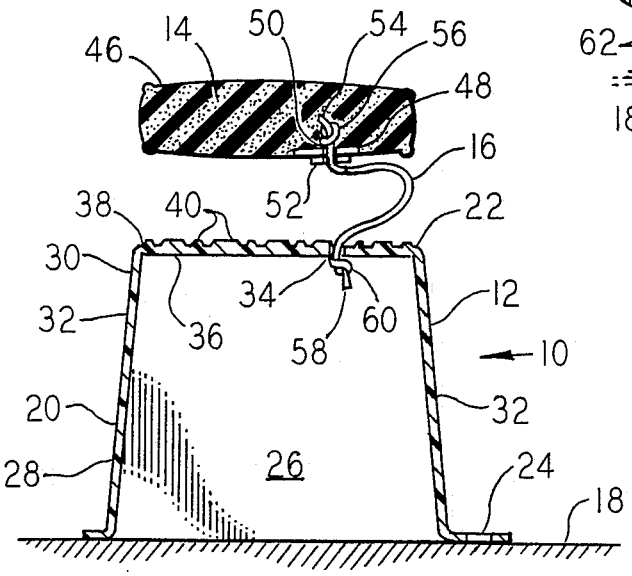
FIG. 3 shows a cross-sectional, exploded view of the present invention, taken at line 3—3 of FIG. 1.

The present invention as shown in FIGS. 1–3 represents a stool 10, which includes a box-shaped support 12, a cushion 14, and a tether 16. Tether 16 attaches support 12 to cushion 14, as shown in FIGS. 2–3. Stool 10 is intended to support a person or other weight (not shown) above a surface 18. FIG. 1 shows a first embodiment of cushion 14 in a first position relative to support 12. In this first position, cushion 14 overlies support 12 so that the person may have a cushioned support for sitting. FIG. 2 shows a second embodiment of cushion 14 in a second position relative to support 12. In this second position, cushion 14 does not overlie support 12 so that the person may stand directly on support 12 without interference from cushion 14. By standing directly on support 12 and not on cushion 14, cushion 14 remains clean and undamaged.

With continued reference to FIGS. 1–3, support 12 includes a pedestal 20, a seat or top surface 22, and a flange-like base or bottom surface 24. The materials used in forming support 12 are not critical in the present invention and may include plastic, metal, wood, or other relatively rigid materials. In the preferred embodiment, support 12 is molded as a single integrated unit from a suitable rigid plastic material so that it is inexpensively produced and lightweight. The use of lightweight materials promotes portability.

Pedestal 20 is formed from a rigid upright wall which is curved and closed upon itself to define a hollow interior section 26 (see FIG. 3) of stool 10. Pedestal 20 extends from a bottom side 28 proximate base 24 to a top side 30 proximate seat 22. In the preferred embodiment, pedestal 20 includes four distinct wall portions 32 arranged in a square so that wall portions 32 form four of the six sides present in the box-shaped support 12.

Additionally, in the preferred embodiment each of wall portions 32 is approximately 18 inches wide at bottom side 28, approximately 15 inches wide at top side 30, and 15 inches high between bottom side 28 and top side 30. Consequently, each of wall portions 32 resembles a trapezoid. Due to this trapezoidal shape, pedestal 20 tapers inward as it extends from bottom side 28 toward top side 30. This tapering promotes the stability of stool 10 so that stool 10 tends not to tip over when it is being stood upon. Moreover, the tapering promotes the stackability of stool 10 with additional like ones of stool 10, as discussed below.

Seat 22 attaches to pedestal 20 along the entire perimeter of pedestal 20 at top side 30. Seat 22 extends inward relative to pedestal 20 so that it forms a boundary for interior section 26 and a fifth of the six sides present in the box-shaped support 12. Consequently, in the preferred embodiment support 12 represents a box which is entirely enclosed except for an opening at bottom side 28, a tether hole 34 (see FIGS. 2–3), and a first embodiment of a handle opening 44 (see FIG. 2). In the preferred embodiment, tether hole 34 extends through seat 22 but may alternatively extend through one of wall portions 32.

An interior side 36 (see FIG. 3) of seat 22 faces interior section 26. An exterior side 38 of seat 22 opposes interior side 36 and faces outward from support 12. Exterior side 38 provides a slip-resistant surface so that when a person's foot or shoe (not shown) contacts exterior side 38 it tends not to slip. Consequently, the safety of a person standing upon stool 10 is promoted. In addition, the slip-resistance feature of side 38 allows cushion 14 to remain in place while in the first position (see FIG. 1) in spite of a reasonable amount of movement by a person sitting on stool 10.

In the preferred embodiment of the present invention, exterior side 38 includes a multiplicity of integrally formed corrugation lines 40 (see FIGS. 2–3) which extend outward from exterior side 38 to form this slip-resistant surface. Lines 40 are arranged in first and second mutually perpendicular directions. Approximately one-half of corrugation lines 40 reside in the first direction and approximately one-half reside in the second direction in all sections of exterior side 38. As an alternate embodiment, exterior side 38 may be formed to have a rough, rather than smooth, finish in a molding process which forms support 12.

In a first embodiment, base 24 is a planar surface (see FIGS. 1 and 3) which immovably attaches to pedestal 20 along the entire perimeter of pedestal 20 at bottom side 28. In a second embodiment, base 24 has a plurality of corrugations 62 (see FIG. 2) which are integrally formed therein and prevent slippage of support 12 on surface 18 and to increase the strength of base 24. In either embodiment, base 24 extends only outward from pedestal 20 so that a maximized opening area is provided into interior section 26 (see FIG. 3). In addition, the extension of base 24 outward from pedestal 20 improves the stability of stool 10. Base 24 extends peripherally away from pedestal 20 for a predetermined distance, which is approximately one inch in the preferred embodiment, in a direction which is generally parallel to seat 22.

Base 24 operates in conjunction with seat 22 and pedestal 20 to distribute the weight of a person or other object being supported by stool 10 over a larger area than occurs with the use of conventional stool or chair legs. Consequently, the pressure applied to any single localized area of surface 18 decreases. Moreover, stool 10 tends not to make substantial holes or indentions in surface 18, even when surface 18 is a relatively soft surface, such as ground. Furthermore, stool 10 tends to remain on top of surface 18 so that it continues to effectively serve its intended function.

The first embodiment of base 24 is integrally formed to include a second embodiment of a handle 42 (see FIG. 1). Handle 42 extends further outward from pedestal 20 than other portions of base 24 and contains opening 44 therein. The first embodiment of handle 42 is illustrated in FIG. 2. In either embodiment, handle 42 at opening 44 may be grasped by a hand of a person using stool 10 in a conventional manner to transport stool 10 from one location to another. Consequently, portability of stool 10 is promoted.

As shown in FIGS. 1 and 3, a first embodiment of cushion 14 may advantageously exhibit peripheral dimensions which are conformal to and slightly smaller than seat 22. A second, circular embodiment of cushion 14 is shown in FIG. 2. Cushion 14 is constructed from standard materials often utilized in cushions, pads, pillows, and the like. However, in the preferred embodiment, an exterior covering 46 of cushion 14 is made from a material, such as canvas or vinyl, which resists the effects of weather.

In addition, an interior portion of the first embodiment of cushion 14 may advantageously include a plate 48 (see FIG. 3) located adjacent to the interior side of exterior covering 46. Plate 48 has a hole 50 therethrough which is aligned with an opening 52 through exterior covering 46. A first end 54 of tether 16 is inserted through opening 52 and hole 50 then configured to include a knot or other projection 56 so that first end 54 of tether 16 cannot return through hole 50 and opening 52. The use of plate 48 distributes forces between projection 56 and exterior covering 46 over a wide area to prevent tether 16 from ripping out from cushion 14.

The second embodiment of cushion 14, shown in FIG. 2, includes an exterior-located eyelet, through which first end 54 of tether 16 is inserted and then configured to include projection 56.

A second end 58 (see FIG. 3) of tether 16 is threaded from the exterior of support 12 through hole 34 into interior section 26, then configured to include a knot or other projection 60. Projection 60 prevents tether 16 from pulling out of hole 34. Consequently, tether 16 movably couples cushion 14 to support 12 so that cushion 14 may be completely removed away from seat 22 to lie alongside one of wall portions 32 when cushion 14 is in its second position (see FIG. 2).

Tether 16 may advantageously be constructed from a suitable chain or rope-like material, such as nylon cord. The length of tether 16 is preferably sufficiently long so that cushion 14 can hang beside pedestal 20 without overlying any portion of seat 22 but sufficiently short so that cushion 14 does not contact surface 18 when cushion 14 is in its second position (see FIG. 2).

Stackability of stool 10 with like ones of stool 10 is promoted in the above-described invention. Due to the above-discussed taper in pedestal 20, the top portion of stool 10 is smaller than the bottom portion of stool 10. The hollow interior section 26 along with the opening in support 12 proximate bottom side 28 of pedestal 20 permits a cushion 14 and top portion of stool 10 to be inserted into another stool 10 for stacking.

In summary, the present invention provides a stool for public and private use. The lightweight materials, hollow interior section, and handle together promote the portability of this stool. In addition, the base operates to promote stability while simultaneously preventing damage to landscape where the stool may be used.

Moreover, the tapered pedestal of the present invention further promotes stability while simultaneously allowing the stool to be readily stackable for storage of many of such stools in a minimum amount of storage space.

The present invention has been described above with reference to a preferred embodiment. However, those skilled in the art will recognize that changes and modifications may be made in this preferred embodiment without departing from the scope of the present invention. For example, the present invention contemplates the use of alternate techniques, such as hinges, for movably attaching the cushion to the support. In addition the materials from which the support is formed need not be solid and may, for example, be a rigid lattice. These and other changes and moidifications which are obvious to those skilled in the art are intended to be included within the scope of the present invention.

What is claimed is:

1. A stool for placement of a soft surface to support an average-sized adult person in standing and sitting positions, said stool comprising:

an upright wall surrounding an interior section and extending from a seat side thereof to a base side thereof, said base side opposing said seat side;

a seat surface immovably attached to said seat side of said upright wall and forming a boundary for said interior section, said seat surface being dimensioned to comfortably accommodate the buttocks of said person when said person is in a sitting position;

a weight-distribution flange rigidly attached at said base side of said upright wall and extending outward from said upright wall, said weight-distribution flange extending continuously along said base side and having a bottom surface for contacting said soft surface so that when said bottom surface is placed in contact with said soft surface and said person is supported by said stool, the weight of said person is transmitted through said upright wall and substantially evenly distributed through said flange for application to said soft surface without becoming embedded therein;

a cushion movably coupled to one of said upright wall, seat surface, and weight distribution flange so that said cushion selectively resides in at least a first position overlying said seat surface and a second position not overlying said seat surface; and a tether having first and second ends, said tether first end being attached to one of said upright wall, seat surface, and weight distribution flange, and said tether second end being attached to said cushion to permit movement of said cushion between said first and second positions;

2. An apparatus as claimed in claim 1 wherein said tether first end attaches to said seat surface.

3. An apparatus as claimed in claim 1 wherein said seat surface has an exterior side comprising means for impeding slippage of said weight when said weight is placed on said seat surface.

4. An apparatus as claimed in claim 1 wherein said base surface comprises a plurality of corrugations to impede slippage of said apparatus on said soft surface.

5. An apparatus as claimed in claim 1 additionally comprising a handle formed in one of said upright wall, seat surface, and base surface for use in transporting said apparatus.

6. An apparatus as claimed in claim 5 wherein said handle is integrally formed in said bottom surface and extends outward from said upright wall.

7. An apparatus as claimed in claim 1 wherein said base surface is substantially parallel to said seat surface.

8. An apparatus as claimed in claim 1 wherein said upright wall tapers inward as said upright wall extends from said base side thereof to said seat side thereof.

9. An apparatus as claimed in claim 1 wherein said weight distribution flange and said interior section are configured so that said apparatus is stackable with a like one of said apparatus by inserting a seat surface of said like one into said interior section of said apparatus.

10. A stackable stool for placement on a soft surface to support a person in standing and sitting positions, said stool comprising:

a pedestal shaped to surround a substantially hollow interior section and to taper inwardly from a base side thereof to a seat side thereof, said seat side opposing said base side;

a substantially planar seat attached to said pedestal at said seat side of said pedestal and extending substantially inward so that said set form a boundary for said interior section and has an interior side that faces said interior section and an exterior side that opposes said interior side;

a weight-distribution flange immovably attached to said pedestal at said base side of said pedestal and extending continuously around said pedestal in a direction outward from and substantially parallel to said seat, said weight-distribution flange having a substantially planar bottom surface for contacting said soft surface so that when said bottom surface is placed in contact with said soft surface and said person is supported by said stool, the weight of said person is substantially transmitted through pedestal and substantially evenly distributed through said flange for application to said soft surface without becoming embedded therein;

a cushion movably coupled to one of said pedestal, seat, and weight-distribution flange so that said cushion selectively resides in at least a first position adjacent to said exterior side of said seat to accommodate said sitting position and a second position not overlying said seat to accommodate said standing position;

a tether having first and second ends, said tether first end being attached to one of said pedestal, seat and weight distribution flange, and said tether second end being attached to said cushion; and means, located on said exterior side of said seat, for impeding slippage of said person when said person is in said standing position and of said cushion when said person is in said sitting position.

11. A stool as claimed in claim 10 wherein said means for impeding slippage comprises a multiplicity of corrugated lines integrally formed in said seat.

12. A stool as claimed in claim 10 additional comprising a handle formed in one of said weight distribution flange and said pedestal.

13. A stool as claimed in claim 10 wherein said weight distribution flange comprises a plurality of corrugations integrally formed therein to impede slippage of said stool.

14. A stool as claimed in claim 10, wherein said substantially planar seat is dimensioned to comfortably accommodate the buttocks of an average-sized adult person.

15. A stackable, portable stool for supporting a person in standing and sitting positions in an out-of-doors environment without substantially damaging said environment, said stool comprising:

a pedestal shaped to surround a substantially hollow interior section and to taper inwardly from a base side thereof to a seat side thereof, said seat side opposing said base side;

a substantially planar seat attached to said pedestal at said seat side of said pedestal and extending only inward so that said seat forms a boundary for said interior section and has an interior side that faces said interior section and an exterior side that opposes said interior side, said seat having a multiplicity of corrugated lines integrally formed therein at said exterior side to impede slippage;

a weight-distribution flange immovably attached to said pedestal at said base side of said pedestal and extending only outward from said pedestal in a direction substantially parallel to said seat and having a substantially planar bottom surface for contacting said environment so that when said bottom surface is placed in contact with said environment and said person is supported by said stool, the weight of said person is transmitted through said pedestal and substantially evenly distributed through said flange for application to said environment;

a tether having first and second ends, said tether first end being attached to one of said pedestal, seat, and weight-distribution flange; and a cushion attached to said tether second end so that said cushion selectively resides in at least a first position adjacent to said exterior side of said seat to accommodate said sitting position and a second position not overlying said seat to accommodate said standing position.

16. A stool as claimed in claim 15 wherein one of said weight distribution flange and said pedestal comprises a handle integrally formed therein.

17. A stool as claimed in claim 15, wherein said substantially planar seat is dimensioned to comfortably accommodate the buttocks of an average-sized adult person.

* * * * *